US005905011A

United States Patent [19]

Kurose et al.

[11] Patent Number: 5,905,011

[45] Date of Patent: May 18, 1999

[54] NONMAGNETIC MONOCOMPONENT NEGATIVELY CHARGEABLE COLOR DEVELOPER

[75] Inventors: Katsunori Kurose, Amagasaki; Masahiro Anno, Sakai; Chikara Tsutsui, Nishinomiya; Minoru Nakamura, Itami; Hiroyuki Fukuda, Kobe, all of Japan

[73] Assignee: Minolta Co., Ltd., Osaka, Japan

[21] Appl. No.: 09/038,904

[22] Filed: Mar. 12, 1998

[30] Foreign Application Priority Data

Mar. 12, 1997 [JP] Japan ..... 9-057577

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,590,139 | 5/1986 | Imai et al. | 430/45 |
| 4,623,605 | 11/1986 | Kato | 430/110 |
| 4,626,487 | 12/1986 | Mitsuhashi et al. | 430/109 |
| 4,767,688 | 8/1988 | Hashimoto et al. | 430/110 |
| 5,126,221 | 6/1992 | Chiba et al. | 430/45 |
| 5,272,034 | 12/1993 | Kawano et al | 430/137 |
| 5,272,040 | 12/1993 | Nakasawa et al. | 430/110 |
| 5,300,383 | 4/1994 | Tsubota et al. | 430/45 |
| 5,314,773 | 5/1994 | Kubo et al. | 430/45 |
| 5,776,071 | 7/1998 | Kido et al. | 430/111 |
| 5,804,350 | 9/1998 | Sekiguchi et al. | 430/110 |
| 5,814,428 | 9/1998 | Kido et al. | 430/110 |
| 5,827,632 | 10/1998 | Inaba et al. | 430/111 |

FOREIGN PATENT DOCUMENTS

| | | |
|---|---|---|
| 01306861 | 12/1989 | Japan . |
| 03063664 | 3/1991 | Japan . |
| 03112990 | 5/1991 | Japan . |

*Primary Examiner*—Roland Martin
*Attorney, Agent, or Firm*—McDermott, Will & Emery

[57] ABSTRACT

A nonmagnetic monocomponent negatively chargeable color developer which has excellent light transmittancy for overhead projection transparencies, excellent transfer characteristics, charging characteristics, and durability is provided. The nonmagnetic monocomponent negatively chargeable color developer contains color toner particles that contain a chromatic color colorant, binder resin, and charge control agent, and an exterior additive added to the exterior of said toner particles. The binder resin is a linear polyester resin having a softening point of about 100° to about 120° C., the sum of the acid value and the hydroxyl value is about 20 to about 40 KOH mg/g, and the weight-average molecular weight/number-average molecular weight ratio is less than about 10. The charge controller is a boron compound having the general structural formula (A) below:

(A)

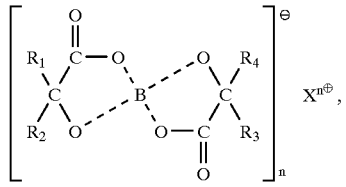

wherein $R_1$ and $R_8$ is a substituted or nonsubstituted aryl groups; $R_2$ and $R_4$ is a member selected from the group consisting of hydrogen, alkyl group, substituted or nonsubstituted aryl group; X represents a cation, and n is an integer of either 1 or 2. The exterior additive is a hydrophobic silica and hydrophobic titanium dioxide in a hydrophobic silica. The hydrophobic titanium dioxide weight ratio is about 1:1 to about 1:3 by weight. The total specific surface area S of said exterior additive microparticles is about 100 to about 300 ($m^2$/g·wt %), and is determined by equation (1):

$$S=(Ss\cdot Vs)+(St\cdot Vt) \quad (1)$$

wherein Ss is the specific surface area ($m^2$/g) of the hydrophobic silica; Vs is the additive amount (weight percent) of hydrophobic silica relative to the toner particle; St is the specific surface area ($m^2$/g) of the titanium dioxide; and Vt is the additive amount (weight percent) of titanium dioxide relative to the toner particle. The total amount of added exterior additive microparticles is about 0.8 to about 2.5 percent-by-weight relative to the toner particles.

17 Claims, No Drawings

NONMAGNETIC MONOCOMPONENT NEGATIVELY CHARGEABLE COLOR DEVELOPER

FIELD OF THE INVENTION

The present invention relates to a nonmagnetic monocomponent negatively chargeable color developer or toner for use in full color image forming apparatuses, such as full color electrostatic type copiers, full color laser beam printers and the like. The present invention is related to Japanese Patent Application No. 09-057577, which is entirely incorporated herein by reference.

BACKGROUND OF THE INVENTION

Heretofore, image forming methods using developers or toners to develop electrostatic latent images formed on an electrostatic latent image carrying member, e.g., a photosensitive member, and transferring said developer or toner image onto a recording member, e.g., a recording sheet, have been widely used in copiers, printers, facsimile machines and the like. More recently, full color image forming apparatuses, which reproduce multi-color images by overlaying a plurality of color developers or toners, have also become widely used. For example, in such full color image forming apparatuses, multi-color images are reproduced by forming an electrostatic latent image on a negatively charged organic photosensitive member by digital writing thereon via laser beam exposure or the like, reverse developing said electrostatic latent image using negatively chargeable magenta toner, cyan toner, yellow toner, and, as necessary, black toner, and then overlaying the developer/toner images of each said color to form a multi-color image.

To reproduce a multi-color image by overlaying the toner of each color, full color toners must have excellent transfer characteristics. When the amount of toner charge is too high, the adhesion force of the toner on the photosensitive member increases so as to reduce transfer characteristics even when the toner charge amount distribution is relatively broad. Accordingly, full color toners must possess a suitable amount of charge and charge amount distribution.

Designing full color image forming apparatuses for greater compactness has been studied in recent years, but such designs require greater compactness of the developing devices. This requirement is due to the fact that such full color image forming apparatuses require four developing devices to accommodate cyan developer, magenta developer, yellow developer, and black developer, respectively. In designing a developing device for greater compactness, it is beneficial to use nonmagnetic monocomponent developing devices that do not require a mixing mechanism to mix toner and carrier. In nonmagnetic monocomponent developing devices that do not use a carrier, the toner is charged via contact between a developer carrying member and a developer regulating member, such that this type of toner must characteristically be capable of rapidly attaining a suitable amount of charge. Furthermore, the toner must possess a hardness to prevent the loss of microparticles from the toner during contact between the developer carrying member and developer regulating member, as well as to prevent adhesion of the toner on the developer carrying member and developer regulating member.

Accordingly there remains a need for better and more reliable nonmagnetic monocomponent negatively chargeable color developers or toners, and methods for making same, that address the above problems and disadvantages and that provide a developer or toner having, for example, advantageous transfer, stability, charge rise and durability characteristics.

SUMMARY OF THE INVENTION

An object of the present invention is to provide a nonmagnetic monocomponent negatively chargeable color developer which addresses the above-described problems and disadvantages.

Another object of the present invention is to provide a nonmagnetic monocomponent negatively chargeable color developer having excellent transfer characteristics.

A further object of the present invention is to provide a nonmagnetic monocomponent negatively chargeable color developer having excellent charging stability and charge rise characteristics.

A still further object of the present invention is to provide a nonmagnetic monocomponent negatively chargeable color developer having excellent durability.

In accordance with the above and other objects, the present invention is directed to a nonmagnetic negatively chargeable color developer having at least color toner particles comprising a chromatic color colorant, binder resin, and charge control agent, and having an exterior additive microparticles added to the exterior of said toner particles.

In the developer of the present invention, the binder resin is a linear polyester resin having a softening point of about 100° to about 120° C., has an acid value and hydroxyl value sum of about 20 to about 40 KOH mg/g, and has a weight-average molecular weight/number- average molecular weight ratio of less than about 10. The charge controller is a boron compound having the general structural formula (A):

(A)

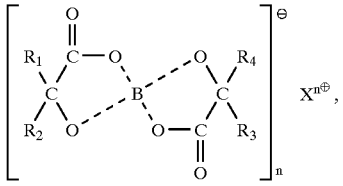

wherein $R_1$ and $R_3$ represent substituted or nonsubstituted aryl groups; $R_2$ and $R_4$ represent hydrogen atoms, alkyl group, substituted or nonsubstituted aryl group; X represents a cation selected, without limitation, from the group consisting of alkali earth metal ion, hydrogen ion, ammonium ion, iminium ion and phsphonium ion; and n is an integer of either 1 or 2. The content of the charge controller is about 0.1 to about 5, preferably about 0.3 to about 3, parts-by-weight hereinafter "pbw") relative to about 100 pbw of the binder resin.

The exterior additive microparticles comprise a hydrophobic silica and hydrophobic titanium dioxide in a hydrophobic silica to hydrophobic titanium dioxide weight ratio of about 1:1 to about 1:3 by weight. The hydrophobic silica has a BET specific surface area of about 40 to about 300 ($m^2/g$), preferably about 100 to about 250 ($m^2/g$), more preferably about 180 to about 250 ($m^2/g$). The hydrophobic titanium dioxide has a BET specific surface area of about 30 to about 150 ($m^2/g$), more preferably about 40 to about 120 ($m^2/g$). The total specific surface area S of said exterior additive microparticles is about 100 to about 300 ($m^2/g \cdot wt\ \%$) and is determined by equation (1):

$$S=(Ss \cdot Vs)+(St \cdot Vt) \quad (1)$$

wherein Ss represents the specific surface area ($m^2/g$) of the hydrophobic silica, Vs represents the additive amount (weight percent) of hydrophobic silica relative to the toner particle, St represents the specific surface area ($m^2/g$) of the titanium dioxide, and Vt represents the additive amount (weight percent) of titanium dioxide relative to the toner particle. The total amount of added exterior additive microparticles relative to the toner particles is about 0.8 to about 2.5 pbw, preferably about 1.0 to about 2.0 pbw.

The colored toners or developers of the present invention may be distributed or sold in any desirable combination of colors, e.g., magenta, cyan, yellow, or black, etc., and included or packaged in a color toner kit or in a so-called imaging cartridge for use in image forming apparatuses, such as full color electrostatic type copiers, full color laser beam printers and the like.

DETAILED DESCRIPTION OF PREFERRED EMBODIMENTS

It is noted that all patents, patent applications and literatures that may be cited in this application are incorporated herein by reference in their entirety. Throughout this application, it will be appreciated that the terms "developer" and "toner" can have equivalent meanings that are not necessarily mutually exclusive depending on the context in which the terms are used. Thus, the terms "developer" and "toner" may be interchangeably used, without limitation, throughout this application.

According to the principles of the present invention, it is preferred that the binder resin is a linear polyester resin having a softening point of about 100° to about 120° C., and preferably about 108° to about 117° C.; has an acid value and a hydroxyl value sum of about 20 to about 40 KOH mg/g, preferably about 24 to about 36 KOH mg/g; and has a weight-average molecular weight/number-average molecular weight ratio of less than about 10, preferably about 3 to about 8.

Because the toner of the present invention uses the above-identified linear polyester resin as a binder resin, it exhibits excellent transmittancy and dispersibility of chromatic color colorants and maintains the strength required in nonmagnetic monocomponent developing methods. It is noted that if the softening point is less than about 100° C., then the toner readily adheres to the developer carrying member and the developer regulating member in the nonmagnetic monocomponent developing device, and although the temperature rises rapidly in conventional compact image forming apparatuses, the toner is susceptible to flocculation and the like. Further, if the softening temperature is higher than about 120° C., then light transmittancy is reduced, particularly where the toner is used to create overhead projector (OHP) images. Moreover, if the sum of the acid value and hydroxyl value is less than about 20 KOH mg/g, toner manufacturability is undesirably reduced due to resin hardness in the pulverization process, thereby reducing light transmittancy in, for example, overhead projector images. If the sum of the acid value and hydroxyl value is greater than about 40 KOH mg/g, then environmental resistance is reduced, and the resin becomes soft. If the weight-average molecular weight/number-average molecular weight ratio exceeds about 10, then the toner sharp-melt characteristics become inadequate and light transmittancy is undesirably reduced.

In a preferred embodiment, the binder resin comprises a linear polyester resin synthesized by condensation polymerization reaction using bisphenol-A alkylene oxide adduct as a main alcohol (i.e., hydroxyl) component, and dicarboxylic acid as an acid component. Desirable linear polyester resins may be synthesized by condensation polymerization reaction using a bisphenol-A alkylene oxide adduct of about 80 molar percent or greater as an alcohol component, and dicarboxylic phthalate adduct of about 90 molar percent or greater as an acid component. Bisphenol-A propylene oxide adduct and bisphenol-A ethylene oxide adduct are suitable as the aforesaid bisphenol-A alkylene oxide adduct, and it is desirable that said adducts are mixed.

Suitable examples of useful alcohol components that may be used in conjunction with the bisphenol-A alkylene oxide adduct include, without limitation, ethylene glycol, diethylene glycol, triethylene glycol, 1,2-propylene glycol, 1,3-propylene glycol, 1,4-butanediol, neopentyl glycol and like diols.

Examples of useful dicarboxylic phthalate include, without limitation, dicarboxylic phthalates such as terephthalate, isophthalate and the like, acid anhydrides and low-molecular alkyl esters thereof.

Examples of useful acid components that may be used together with the dicarboxylic phthalate as the acid component include, but are not limited to, aliphatic dicarboxylic acids such as fumaric acid, maleic acid, succinic acid, akyl or alkenylsuccinic acid and the like, and acid anhydrides or low-molecular alkyl esters thereof.

The softening point of the polyester resin may be measured by the so-called ring and ball method (JIS K2207). Acid value is expressed as the number of milligrams of sodium hydroxide that are necessary to neutralize an acid group when 1 g of resin is dissolved in a suitable solvent using phenolphthalene as an indicator. Hydroxyl value is expressed as the number of milligrams of sodium hydroxide that are necessary to neutralize free acetate when hydrolyzing acetyl compound of 1 g of resin treated by acetic anhydride. Molecular weight is determined via polystyrene conversion using gel permeation chromatography (model 807-IT; Nippon Bunkou Kogyo) by maintaining the column at about 40° C., with a flow of about 1 kg/cm 2 tetrahydrofuran as a carrier solvent, and introducing a 0.5 ml solution of 30 mg of sample dissolved in 20 ml of tetrahydrofuran together with the carrier into the column.

The above-identified linear polyester resin possesses the previously mentioned excellent characteristics, but has relatively weak negative chargeability and inadequate transfer characteristics. Furthermore, charge rise characteristics may also be inadequate and readily produce fog, particularly when using a nonmagnetic monocomponent developer. To eliminate these disadvantages, a charge controller compound having the general structural formula (A) below, is included in the toner:

(A)

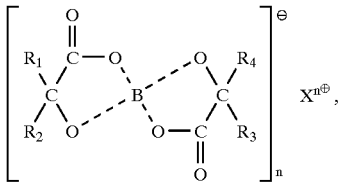

wherein $R_1$ and $R_3$ represent substituted or nonsubstituted aryl groups; $R_2$ and $R_4$ represent hydrogen atoms, alkyl group, substituted or nonsubstituted aryl group; X represents a cation, and n is an integer of either 1 or 2. The inclusion of the charge controller compound reduces the excessive negative charge of the toner having the aforesaid acid value so as to allow a suitable amount of charging and improve the toner charge rise characteristics. The charge controler compound is typically colorless and generally possesses characteristics such as excellent heat resistance, does not breakdown during the manufacturing process or during heat fixing, and does not adversely affect light transmittancy or color reproducibility when used in a fill color toner. This boron-based charge controller compound also has excellent stability because it does not include a heavy metal.

In the above general structural formula (A), the cation represented by X may be any suitable alkali metal ion such as, without limitation, lithium, potassium and the like; alkali earth metal ion such as magnesium, calcium and the like; and hydrogen ion, ammonium ion, iminium ion, phosphonium ion and the like. The aforesaid boron-based compound content is preferably about 0.1 to about 5 pbw, and more preferably about 0.3 to about 3 pbw, relative to about 100 pbw of binder resin. When the boron compound content is less than about 0.1 pbw, the previously mentioned effectiveness is inadequately realized, whereas when the boron compound content exceeds about 5 pbw, the amount of charge is reduced.

Any suitable dye or pigments may be used as the chromatic color colorant in the present invention. Examples include, without limitation, magenta colorants such as CI pigment red 1–19, 21–23, 30–32, 37–41, 48–55, 57, 60, 63, 64, 68, 81, 83, 87–90, 112, 114, 122, 123, 163, 184, 202, 206, 207, 209 and the like; yellow colorants such as CI pigment yellow 1–7, 10–17, 19, 23, 65, 73, 83, and 180, CI vat yellow 1, 3, 20 and the like; and cyan colorants such as CI pigment blue 2, 3, 15–17 and the like.

To improve anti-offset characteristics and prevent adhesion on the developer regulating member, the toner of the present invention may include, without limitation, waxes such as low-molecular weight polypropylene wax, low-molecular weight polyethylene wax, carnuba wax, sasol wax and the like. Desirable waxes will have an acid value of about 0.5 to about 30 KOH mg/g from the perspective of dispersibility in the linear polyester resin.

Manufacturing methods for toner particles of the present invention are not particularly limited and may be include, without limitation, kneading pulverization, suspension polymerization, emulsion polymerization, emulsion-dispersion granulation, capsulation and the like. When adding chromatic color colorant during the manufacturing process, it is desirable to use a colorant produced by a master batch or flashing process to improve dispersibility.

Color toner particle of the present invention should be regulated so as to have a volume-average particle size of about 4–10 $\mu$m, and preferably about 6–9 $\mu$m, from the perspective of high resolution image reproducibility. The toner of the present invention may also include hydrophobic silica and hydrophobic titanium dioxide as exterior additive particles or microparticles. In the present invention, hydrophobic silica and hydrophobic titanium dioxide mean silica and titanium dioxide subjected to surface treatment by a hydrophobic agent such as silane coupling agent, silicone oil and the like.

The ratio of added hydrophobic silica and hydrophobic titanium dioxide in the present invention is about 1:1 to about 1:3 by weight, such that the exterior additive specific surface area S expressed by the equation $S=(Ss\cdot Vs)+(St\cdot Vt)$ (where Ss represents the specific surface area ($m^2/g$) of the hydrophobic silica, Vs represents the additive amount (weight percent) of hydrophobic silica relative to the toner particle, St represents the specific surface area ($m^2/g$) of the titanium dioxide, and Vt represents the additive amount (weight percent) of titanium dioxide relative to the toner particle) is about 100 to about 300 ($m^2\cdot$wt %), and preferably about 120 to about 250, and the total amount of added exterior additive microparticles is about 0.8 to about 2.5 percent-by-weight relative to the toner particles. The solid image tracking characteristics in nonmagnetic monocomponent developing, charge stability of the toner relative to environmental fluctuation, transfer characteristics from the photosensitive member to the recording sheet, and prevention of fog during printing can be adequately improved by adding the hydrophobic silica and hydrophobic titanium dioxide at a particular weight ratio, a particular total specific surface area, and a particular total content. In other words, if the weight ratio of hydrophobic silica is excessive, then insufficient transfer results from charge accumulation under environmental conditions of low temperature and low humidity, and when the weight ratio is too low, durability is reduced such that the regulating member in the developing device causes streaking which results in image noise. In addition, inadequately charged toner is readily produced. When the total specific surface area is less than 100 ($m^2\cdot$wt %), there is inadequate tracking of solid images, and when the total specific surface area is greater than 300 ($m^2\cdot$wt %), the toner easily passes by the regulating member in the developing device so as to result in inadequately charged toner. Even when the aforesaid weight ratio and total specific surface area parameters are met, tracking characteristics and durability are reduced and fogging occurs if the total additive content is outside the aforesaid range.

A desirable hydrophobic silica will have a BET specific surface area of about 40 to about 300 ($m^2/g$), preferably about 100 to about 250 ($m^2/g$), and more preferably about 180 to about 250 ($m^2/g$). A desirable hydrophobic titanium dioxide will have a BET specific surface area of about 30 to about 150 ($mg^2l/g$), and preferably about 40 to about 120 ($m^2/g$).

According to the present invention, the inventive nonmagnetic color developer eliminates various problems and disadvantages associated with conventional nonmagnetic monocomponent developing methods used in a construction or apparatus wherein the blade of a developer regulating member is pressed against a developing sleeve of a developer carrying member, and wherein toner is charged by passing said toner past a regulating member.

The advantages of the present invention will be further illustrated in the following, non-limiting Examples. The Examples merely illustrate embodiments of the present invention and are not intended to limit the claimed invention regarding the materials, conditions, process parameters and the like recited herein.

In the following examples, the hydrophobic silica and hydrophobic titanium dioxide used therein as follows:

- hydrophobic silica A: BET specific surface area of about 225 $m^2/g$ (TS500; Cabot);
- hydrophobic silica B: BET specific surface area of about 140 $m^2/g$, (H2000 Hoescht);
- hydrophobic silica C: BET specific surface area of about 50 $m^2/g$ (R809; Japan Aerosil Co. Ltd.);
- hydrophobic titanium dioxide A: BET specific surface area of about 100 $m^2/g$ (anatase type titanium dioxide having a mean primary particle size of about 20 nm surface treated by n-hexyltrimethoxysilane, and subsequently surface treated by fluorine-silane coupling agent and 3,3,4,4,5,5,6,6,7,7,8,8,10,10,10-heptadecafluorodecyltrimethoxysilane);
- hydrophobic titanium dioxide B: BET specific surface area of about 50 $m^2/g$ (anatase type titanium dioxide having a mean primary particle size of about 50 nm and surface treated in the same manner as hydrophobic titanium dioxide A);

hydrophobic titanium dioxide C: BET specific surface area of about 80 $m^2/g$ (rutile type titanium dioxide having a mean primary particle size of about 15 nm (MT-150W; Teica Co.Ltd) and surface treated in the same manner as hydrophobic titanium dioxide A);

hydrophobic titanium dioxide D: BET specific surface area of about 35 $m^2/g$ (rutile type titanium dioxide having a mean primary particle size of about 35 nm (MT-500B; Teica Co.Ltd) and surface treated in the same manner as hydrophobic titanium dioxide A).

EXAMPLES OF POLYESTER RESINS A–G

Alcohol component and acid component in the molar ratio shown in Table 1 together with a polymerization catalyst (dibutyl tin oxide) were introduced into a four-mouth glass flask on which were mounted a thermometer, reflux condenser, and nitrogen tube. The mixture was induced to react by mixing at a temperature of about 220° C. in a mantle heater in a nitrogen atmosphere to obtain polyester resins A–G having the softening point (Tm), acid value+hydroxyl value (AV+OHV), number-average molecular weight (Mn), and weight-average molecular weight/number-average molecular weight ratio (Mn/Mw) shown in Table 1.

In Table 1, PO represents polyoxypropylene(2,2)-2,2-bis(4-hydroxyphenol)propane, EO represents polyoxyethylene (2,2)-2,2-bis(4-hydroxyphenol)propane, TPA represents terephthalic acid, SA represents succinic acid, TMA represents trimellitic acid, and FA represents fumaric acid.

TABLE 1

| | Alcohol component | | Acid component | | | | Tm | AV + OHV (KOH | | Mw/ |
|---|---|---|---|---|---|---|---|---|---|---|
| Resin | PO | EO | TPA | SA | TMA | FA | (° C.) | mg/g) | Mn | Mn |
| A | 7.5 | 2.5 | 4.0 | — | — | 6.0 | 115 | 28 | 4600 | 4.5 |
| B | 5.0 | 5.0 | 10 | — | — | — | 113 | 33 | 3400 | 4.9 |
| C | 5.0 | 5.0 | 4.0 | — | — | 5.0 | 105 | 34 | 4800 | 4.8 |
| D | 7.0 | 3.0 | 5.0 | 4.0 | 0.1 | — | 110 | 30 | 5200 | 12.0 |
| E | 10 | — | 8.0 | — | — | — | 115 | 48 | 2900 | 8.0 |
| F | — | 10 | 5.0 | — | — | 5.0 | 98 | 45 | 3600 | 5.5 |
| G | 5.0 | 5.0 | 7.0 | — | 0.3 | 0.5 | 122 | 50 | 2700 | 43.0 |

Example 1

Polyester resin A and cyan pigment (CI pigment blue 15:3) were kneaded in a pressure kneader to achieve a weight resin-to-pigment weight ratio of about 7:3. The kneaded material was cooled, then pulverized in a feather mill to obtain a pigment master batch.

A mixture of about 93 pbw polyester resin A, about 10 pbw of the aforesaid pigment master batch, about 2 pbw polypropylene wax (Biscol TS200; Sanyo Kasei Kogyo) and about 1.5 pbw charge controller having the general structural formula (B) shown below were thoroughly mixed.

(B)

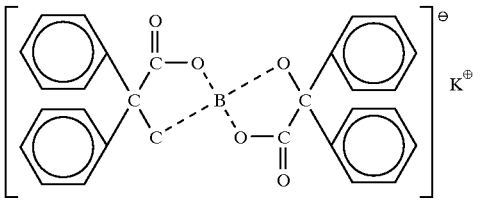

The mixture was thereafter kneaded in a twin-shaft extrusion kneader (model PCM-30; Ikegaitekou Co.Ltd), and after cooling the cooled material was coarsely pulverized using a feather mill, thin finely pulverized using a jet mill, and finally the finely pulverized material was classified to obtain yellow toner particles having a volume-average particle size of about 8.0 $\mu$m. To these toner particles were added about 0.4 percent-by-weight (hereinafter "wt %") hydrophobic silica A having a BET specific surface area of about 225 $m^2/g$ (TS500; Cabosil Co.Ltd) and about 1.0 wt % hydrophobic titanium dioxide A having a BET specific surface area of about 100 $m^2/g$ to obtain the final toner.

Examples 2–12

Toners were produced in the same manner as in Example 1 with the exception that the constituents listed in Table 2 were used.

Comparative Examples 1–16

Toner exemplified in Comparative Examples 1–16 were produced in the same manner as described in Example 1 with the exception that the constituents listed in Table 2 were used. In Table 2, E84 represents zinc salicylate complex charge controller (E84; Orient Chemical Industries), and VP434 represents quaternary ammonium salt with fluorine charge controller (VP434; Hoechest Co.Ltd).

TABLE 2

| | | Silica | | Titanium dioxide | | | |
|---|---|---|---|---|---|---|---|
| | Poly-ester resin | Type | Amt. added (%) | Type | Amt. added (%) | Total specific surface area ($m^2/g$) | Charge controller |
| Ex 1 | A | A | 0.4 | A | 1.0 | 190 | (B) |
| Ex 2 | B | A | 0.4 | A | 1.0 | 190 | (B) |
| Ex 3 | C | A | 0.4 | A | 1.0 | 190 | (B) |
| Ex 4 | B | A | 0.4 | B | 1.0 | 140 | (B) |
| Ex 5 | B | A | 0.5 | A | 0.6 | 172.5 | (B) |
| Ex 6 | B | B | 0.8 | A | 1.0 | 212 | (B) |
| Ex 7 | B | B | 0.8 | B | 1.0 | 162 | (B) |
| Ex 8 | B | A | 0.8 | A | 1.0 | 280 | (B) |
| Ex 9 | B | A | 0.8 | B | 1.0 | 230 | (B) |
| Ex 10 | B | C | 0.6 | A | 1.2 | 150 | (B) |
| Ex 11 | B | C | 1.0 | A | 1.5 | 200 | (B) |
| Ex 12 | B | A | 0.5 | C | 1.0 | 192.5 | (B) |
| CE 1 | D | A | 0.4 | A | 1.0 | 190 | (B) |
| CE 2 | E | A | 0.4 | A | 1.0 | 190 | (B) |
| CE 3 | F | A | 0.4 | A | 1.0 | 190 | (B) |
| CE 4 | G | A | 0.4 | A | 1.0 | 190 | (B) |
| CE 5 | B | A | 0.8 | D | 0.4 | 194 | (B) |
| CE 6 | B | B | 1.0 | C | 0.5 | 180 | (B) |
| CE 7 | B | A | 0.5 | B | 2.0 | 212.5 | (B) |
| CE 8 | B | A | 0.8 | A | 1.5 | 330 | (B) |
| CE 9 | B | C | 0.8 | B | 1.0 | 90 | (B) |
| CE 10 | B | A | 0.2 | B | 0.5 | 70 | (B) |
| CE 11 | B | C | 0.8 | B | 2.0 | 140 | (B) |

TABLE 2-continued

| | Poly-ester resin | Silica Type | Silica Amt. added (%) | Titanium dioxide Type | Titanium dioxide Amt. added (%) | Total specific surface area ($m^2/g$) | Charge controller |
|---|---|---|---|---|---|---|---|
| CE 12 | B | A | 0.4 | A | 1.0 | 190 | E84 |
| CE 13 | B | A | 0.4 | A | 1.0 | 190 | VP434 |

The toners of the above-identified examples and comparative examples were evaluated as described below; evaluation results are shown in Table 3.

FOG

An electrophotographic printer (model SP1000; Minolta Co., Ltd.) equipped with a nonmagnetic monocomponent developing unit was used to make 10 prints of a character pattern comprising a black-to-white ratio of about 5% under low temperature and low humidity (LL; 10° C., 15% RH) conditions and under high temperature and high humidity (HH; 30° C., 85% RH) conditions. These prints were visually examined and evaluated by the following ranking criteria: A=no fog; B=slight fog which posed no practical problem; and C=fog which prevented practical use.

Transfer Characteristics

A modified electrophotographic printer (model SP1000; Minolta Co., Ltd.) was used to make 10 prints of a character pattern comprising a black-to-white ratio of about 5% LL conditions and HH conditions. The ratio of the amount of toner adhered to the transfer sheet relative to the amount of toner adhered to the surface of the photosensitive drum was determined. These prints were visually examined and evaluated by the following ranking criteria: A=a ratio of about 80% or higher; B=a ratio of about 70% or higher but less than about 80%; and C=a ratio of less than about 70%.

Charge Rise Characteristics

A modified electrophotographic printer (model SP1000; Minolta Co., Ltd.) was used to make 10 prints of a character pattern comprising a black-to-white ratio of about 5% under normal temperature and normal humidity conditions (NN; 25° C., 45% RH). The density of these printed images at 1.5 cm from the leading edge of the A4 solid image and at 5 cm from the leading edge were visually examined and evaluated by the following ranking criteria: A =no density difference indicating excellent charge rise characteristics; B =slight density difference which posed no practical problem; and C =pronounced density difference indicating poor charge rise characteristics.

Tracking Characteristics

A modified electrophotographic printer (model SP1000; Minolta Co., Ltd.) was used to make 10 prints of a character pattern comprising a black-to-white ratio of about 5% under normal temperature and normal humidity conditions (NN; 25° C., 45% RH). The densities of the bottom and top regions of the printed A4 solid image were visually examined and evaluated by the following ranking criteria: A=no density difference indicating excellent tracking (flow characteristics); B=slight density difference which posed no practical problem; and C=pronounced density difference indicating poor tracking characteristics.

White Streaks

A modified electrophotographic printer (model SP1000; Minolta Co., Ltd.) was used to make 2,000 prints of a character pattern comprising a black-to-white ratio of about 5% under NN conditions. Initial (after 10 prints) and final (after 2,000 prints) A4 halftone prints and the thin toner layer on the surface of the developing sleeve were examined and evaluated by the following ranking criteria: A=the absence of streaks in the thin toner layer on the sleeve and absence of white streaks in the printed image; B=slight streaking of the thin toner layer without white streaks in the printed image; and C=streaks in the thin toner layer with white streaks in the printed image.

Post Print Fog

A modified electrophotographic printer (model SP1000; Minolta Co., Ltd.) was used to make 2,000 prints of a character pattern comprising a black-to-white ratio of 5% under NN conditions. The printed images were visually examined and evaluated by the following ranking criteria: A=complete absence of fog; B=slight fog which posed no practical problem; and C=definite fog which precluded practical use.

Overhead Projector (OHP) Transmittancy

A modified model SP 1000 was used to make 10 prints of a character pattern comprising a black-to-white ratio of about 5% under NN conditions, then solid images were printed on OHP transparencies. The coloration of the image was visually examined when the transparencies were projected on an overhead projector and evaluated by the following ranking criteria: A=sharp coloration; B=slightly dull coloration; and C=dull coloration.

TABLE 3

| | Fog LL | Fog HH | Transfer LL | Transfer HH | Charge rise | Tracking | White streaks Start | White streaks End | Post print fog | Transmittancy |
|---|---|---|---|---|---|---|---|---|---|---|
| Ex 1 | A | A | A | A | A | A | A | A | A | A |
| Ex 2 | A | A | A | A | A | A | A | A | A | A |
| Ex 3 | A | A | A | A | A | A | A | B | B | A |
| Ex 4 | A | A | A | A | A | A | A | A | A | A |
| Ex 5 | A | A | B | A | A | A | A | A | A | A |
| Ex 6 | A | A | A | A | A | A | A | A | A | A |
| Ex 7 | A | A | A | A | A | A | A | A | A | A |
| Ex 8 | A | B | A | A | A | A | A | A | A | A |
| Ex 9 | A | A | B | A | A | A | A | A | A | A |
| Ex 10 | A | B | A | A | A | B | A | B | B | A |

TABLE 3-continued

| | Fog | | Transfer | | Charge | | White streaks | | Post print | |
|---|---|---|---|---|---|---|---|---|---|---|
| | LL | HH | LL | HH | rise | Tracking | Start | End | fog | Transmittancy |
| Ex 11 | A | B | A | A | A | B | A | A | A | A |
| Ex 12 | A | A | A | A | A | A | A | A | A | A |
| CE 1 | A | A | A | A | A | A | A | B | B | C |
| CE 2 | A | A | A | A | A | A | A | C | C | A |
| CE 3 | B | B | A | A | B | A | B | — | — | A |
| CE 4 | A | B | A | A | A | A | A | B | B | C |
| CE 5 | A | B | C | A | A | A | A | A | A | A |
| CE 6 | A | A | C | A | A | A | A | A | A | A |
| CE 7 | B | B | A | A | A | A | C | — | — | A |
| CE 8 | B | C | A | A | B | A | A | A | B | A |
| CE 9 | A | A | B | A | B | C | B | — | — | A |
| CE 10 | A | A | B | A | B | C | B | — | — | A |
| CE 11 | A | B | A | A | B | B | B | — | — | A |
| CE 12 | A | A | C | A | A | A | A | A | A | A |
| CE 13 | A | C | A | A | C | A | A | — | — | A |

In comparative examples 3 and 9–11, evaluations were stopped during printing due to the extreme degree of image noise caused by white streaks. In comparative example 13, evaluations were stopped during printing due to the marked fogging observed.

From the above examples and comparative examples, it may be appreciated, without limitation of the invention as claimed, that the present invention provides an environmentally stable, nonmagnetic monocomponent negatively chargeable color developer which has excellent transfer characteristics, charge and ise characteristics, durability.

It will be appreciated that the color developers or toners of the present invention may be commercially distributed in any desirable color or combination of colors, e.g., magenta, cyan, yellow, or black, etc., and may be included or packaged in a saleable color toner kit or in a so-called saleable imaging cartridge for use in an image forming apparatuses, e.g., full color electrostatic type copiers, full color laser beam printers and the like.

Although the present invention has been fully described by way of the above detailed description and examples, various changes and modifications will be apparent to those skilled in the art. Those skilled in the art will recognize, or be able to ascertain using no more than routine experimentation, many equivalents to the specific embodiments of the invention specifically described herein. Such equivalents are intended to be encompassed within the scope of the following claims.

What is claimed is:

1. A nonmagnetic monocomponent negatively chargeable color developer or toner, comprising:

a chromatic color colorant;

a binder resin comprising a linear polyester resin having a softening point of about 100° to about 120° C., said binder resin having an acid value and hydroxyl value sum of about 20 to about 40 KOH mg/g, and a weight-average molecular weight/number-average molecular weight ratio of less than about 10;

a charge controller comprising a boron compound having the general structural formula (A):

(A)

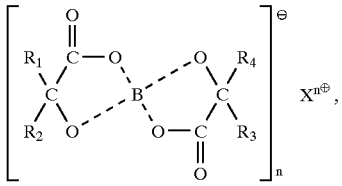

wherein each $R_1$ and $R_3$ is a substituted or nonsubstituted aryl group; each $R_2$ and $R_4$ is a member selected from the group consisting of hydrogen, alkyl group, and substituted or nonsubstituted aryl group; X is a cation, and n is the integer 1 or 2; and an exterior additive microparticles comprising a hydrophobic silica and a hydrophobic titanium dioxide.

2. The developer of claim 1, wherein said hydrophobic silica weight ratio to the hydrophobic titanium dioxide is about 1:1 to about 1:3 by weight and the total specific surface area S of said exterior additive microparticles is about 100 to about 300 ($m^2$·wt %), and is determined by equation (1):

$$S=(Ss\cdot Vs)+(St\cdot Vt) \quad (1)$$

and the total amount of added exterior additive microparticles is about 0.8 to about 2.5 percent-by-weight relative to the toner particles.

3. The developer of claim 2, wherein said total amount of added exterior additive microparticles is about 1.0 to about 2.0 percent-by-weight relative to the toner particles.

4. The developer of claim 1, wherein said X of formula (A) is selected from the group consisting of alkali earth metal ion, hydrogen ion, ammonium ion, iminium ion and phosphonium ion.

5. The developer of claim 1, wherein the content of the charge controller is about 0.1 to about 5 parts-by-weight relative to about 100 parts-by-weight of the binder resin.

6. The developer of claim 5, wherein the content of the charge controller is about 0.3 to about 3 parts-by-weight relative to about 100 parts-by-weight of the binder resin.

7. The developer of claim 1, wherein said hydrophobic silica has a BET specific surface area of about 40 to about 300 ($m^2$/g).

8. The developer of claim 7, wherein said hydrophobic silica has a BET specific surface area of about 100 to about 250 ($m^2$/g).

9. The developer of claim 8, wherein said hydrophobic silica has a BET specific surface area of about 180 to about 250 ($m^2/g$).

10. The developer of claim 1, wherein said hydrophobic titanium dioxide has a BET specific surface area of about 30 to about 150 ($m^2/g$).

11. The developer of claim 10, wherein said hydrophobic titanium dioxide has a BET specific surface area of about 40 to about 120 ($m^2/g$).

12. The developer of claim 1, wherein the charge controller comprises the formula (B):

(B)

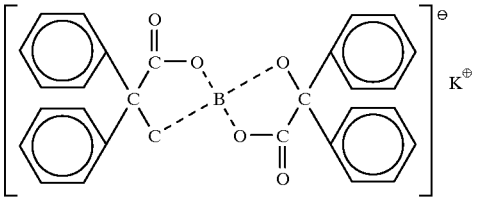

13. The developer of claim 1, wherein the developer has a volume-average particle size of about 4 to about 10 $\mu$m.

14. The developer of claim 13, wherein the developer has a volume-average particle size of about 6 to about 9 $\mu$m.

15. The developer of claim 1, further comprising a low-molecular weight polypropylene wax.

16. The developer of claim 15, wherein the low-molecular weight polypropylene wax has an acid value of about 0.5 to about 30 KOH mg/g.

17. The developer of claim 1, wherein the developer is used for an image forming apparatus including a cartridge.

* * * * *